US006162403A

United States Patent [19]

Foster et al.

[11] Patent Number: 6,162,403

[45] Date of Patent: Dec. 19, 2000

[54] SPIN FORMED VACUUM BOTTLE CATALYTIC CONVERTER

[75] Inventors: Michael Ralph Foster, Columbiaville; Egas Jose De Sousa, Grand Blanc; William H. Braatz, Highland, all of Mich.

[73] Assignee: General Motors Corporation, Detroit, Mich.

[21] Appl. No.: 09/184,430

[22] Filed: Nov. 2, 1998

[51] Int. Cl.[7] ..... F01N 3/28; F01N 53/34; F01N 53/88

[52] U.S. Cl. ..... 422/173; 422/177; 422/180; 422/179; 422/175; 60/300

[58] Field of Search ..... 422/171, 177, 422/175, 179, 173, 180, 222, 221; 60/300, 303; 55/DIG. 30

[56] References Cited

U.S. PATENT DOCUMENTS

| | | | |
|---|---|---|---|
| 2,659,128 | 1/1953 | Baldwin, Jr. et al. | 29/422 |
| 3,498,245 | 3/1970 | Hansson | 72/84 |
| 3,653,240 | 4/1972 | Huthsing, Jr. | 72/82 |
| 3,793,699 | 2/1974 | Merola | 29/415 |
| 3,793,863 | 2/1974 | Groppini | 72/84 |
| 3,815,397 | 6/1974 | Hollencamp | 72/121 |
| 3,852,041 | 12/1974 | Moore et al. | 425/388 |
| 3,859,831 | 1/1975 | Timmermans | 72/68 |
| 3,874,854 | 4/1975 | Hunter, Jr. | 422/175 |
| 3,975,826 | 8/1976 | Balluff | 29/890 |
| 4,239,733 | 12/1980 | Foster et al. | 422/179 |
| 4,347,219 | 8/1982 | Noritake et al. | 422/180 |
| 4,782,570 | 11/1988 | Spridco | 29/890 |
| 4,886,711 | 12/1989 | Foldvary | 428/592 |
| 4,953,376 | 9/1990 | Merlone | 72/57 |
| 5,055,274 | 10/1991 | Abbott | 422/171 |
| 5,187,142 | 2/1993 | Richmond et al. | 502/439 |
| 5,245,848 | 9/1993 | Lee, Jr. et al. | 72/84 |
| 5,330,728 | 7/1994 | Foster | 422/177 |
| 5,419,876 | 5/1995 | Usui et al. | 422/177 |
| 5,477,676 | 12/1995 | Benson et al. | 60/274 |
| 5,489,321 | 2/1996 | Tracy et al. | 65/43 |
| 5,500,503 | 3/1996 | Pernicka et al. | 219/121.64 |
| 5,502,292 | 3/1996 | Pernicka et al. | 219/121.64 |
| 5,531,370 | 7/1996 | Rohrberg | 228/173.4 |
| 5,562,154 | 10/1996 | Benson et al. | 165/96 |
| 5,575,980 | 11/1996 | Turek | 422/181 |
| 5,598,729 | 2/1997 | Hoffmann et al. | 72/8.5 |

FOREIGN PATENT DOCUMENTS

| | | | |
|---|---|---|---|
| 2731965 | 2/1979 | Germany | B21C 37/16 |
| 3423223 | 6/1984 | Germany . | |
| 0425983 | 10/1990 | Germany | F01N 3/28 |
| 0697505 | 7/1995 | Germany | F01N 3/20 |
| 0768451 | 10/1995 | Germany | F01N 3/28 |
| 0763651 | 9/1996 | Germany | F01N 3/20 |
| 57-202930 | 12/1982 | Japan | B21D 19/02 |
| 59-092123 | 5/1984 | Japan | B21D 22/16 |
| 59-2123 | 5/1984 | Japan | B21D 22/16 |
| 59-193724 | 11/1984 | Japan | B21D 22/16 |

OTHER PUBLICATIONS

Ward's Engine & Vehicle Technology Update, Jun. 15, 1994 (2 pages).

SAE Technical Paper Series, "In–Line Hydrocarbon Adsorber System for ULEV" Feb. 26–29, 1996 (20 pages) SAE#960348.

Pending U.S. application, Ser. No. 08/766,269.

J. C. Whitney catalog, 1981, p. 130.

*Primary Examiner*—Hien Tran

*Attorney, Agent, or Firm*—Vincent A. Cichosz

[57] ABSTRACT

A spin formed catalytic converter employs fewer and circumferentially shorter weld joints to reduce manufacturing cost of such catalytic converters.

6 Claims, 2 Drawing Sheets

SPIN FORMED VACUUM BOTTLE CATALYTIC CONVERTER

BACKGROUND OF THE INVENTION

The invention relates to automotive catalytic converters. More particularly, the invention relates to spin forming vacuum bottle catalytic converters and reducing the required welding.

PRIOR ART

Vacuum bottle catalytic converters are known to the automotive industry. Vacuum bottle catalytic converters are used to maintain the catalyst substrate at temperatures above the catalyst light-off temperature for an extended period of time. By so maintaining the temperature of the catalyst, the time period generally required to heat the catalyst to light-off temperature may be reduced or eliminated if vehicle ignition-on occurs within or near that extended time period because the catalyst is already lit. Engines started and stopped regularly and so equipped with these converters will reduce or eliminate many periods of heat-up time of the converter.

Vacuum bottle catalytic converters are traditionally constructed having an outer housing using a vacuum chamber with radiation shields enclosed therein. This assembly reduces thermal loss from the converter to help keep the catalyst hot as above stated. Additionally, some vacuum bottle converters include a phase change material chamber that employs a salt in solid state at ambient environmental temperature but assumes a liquid state when heated by the exhaust gasses and the lit catalyst. Upon shutdown of the engine with which the catalytic converter is associated, the phase change material releases a significant amount of thermal energy over time as it returns to the solid state. A large portion of the thermal energy radiated is directed back to the catalyst substrate due to the radiation shields in the vacuum chamber. Because of the effective time release of thermal energy from the phase change material, the substrate is kept hot for an extended period of time as above stated.

In a known example, vacuum bottle catalytic converters are constructed from full diameter metal tubes which are then closed at the ends by end plates or end cones welded to the tube (or housing). Normally the plates are at full diameter of the converter. Long weld joints are necessary to span the circumference of the housing. The extended weld joints are undesirable because weld joints in vacuum bottle catalytic converters are required to be 100% sealed or the vacuum is lost. Thus, longer or multiple joints require considerable time to construct in order to maintain the desired quality. Reducing the number of welds and the total length of weld necessary is therefore of interest to the industry since so reducing saves time and therefore money.

Spin forming of catalytic converters is also known to the industry. For example, spin forming has been suggested to fabricate the end cones of a converter housing.

SUMMARY OF THE INVENTION

An object of the invention is to provide a vacuum bottle catalytic converter having minimum total weld joint length.

Another object of the invention is to provide a catalytic converter which is entirely spin formed to reduce the total number of weld joints necessary to manufacture the catalytic converter.

It is a further object of the invention to position edges of the various layers of the catalytic converter such that one weld joint will substitute for what would have required a plurality of weld joints in the prior art.

Advantageously, the above objects are carried out by the spin formed vacuum bottle catalytic converter of the invention.

BRIEF DESCRIPTION OF THE DRAWINGS

The present invention will now be described, by way of example only, with reference to the accompanying drawings in which.

DETAILED DESCRIPTION OF THE PREFERRED EMBODIMENTS

Figure 1:
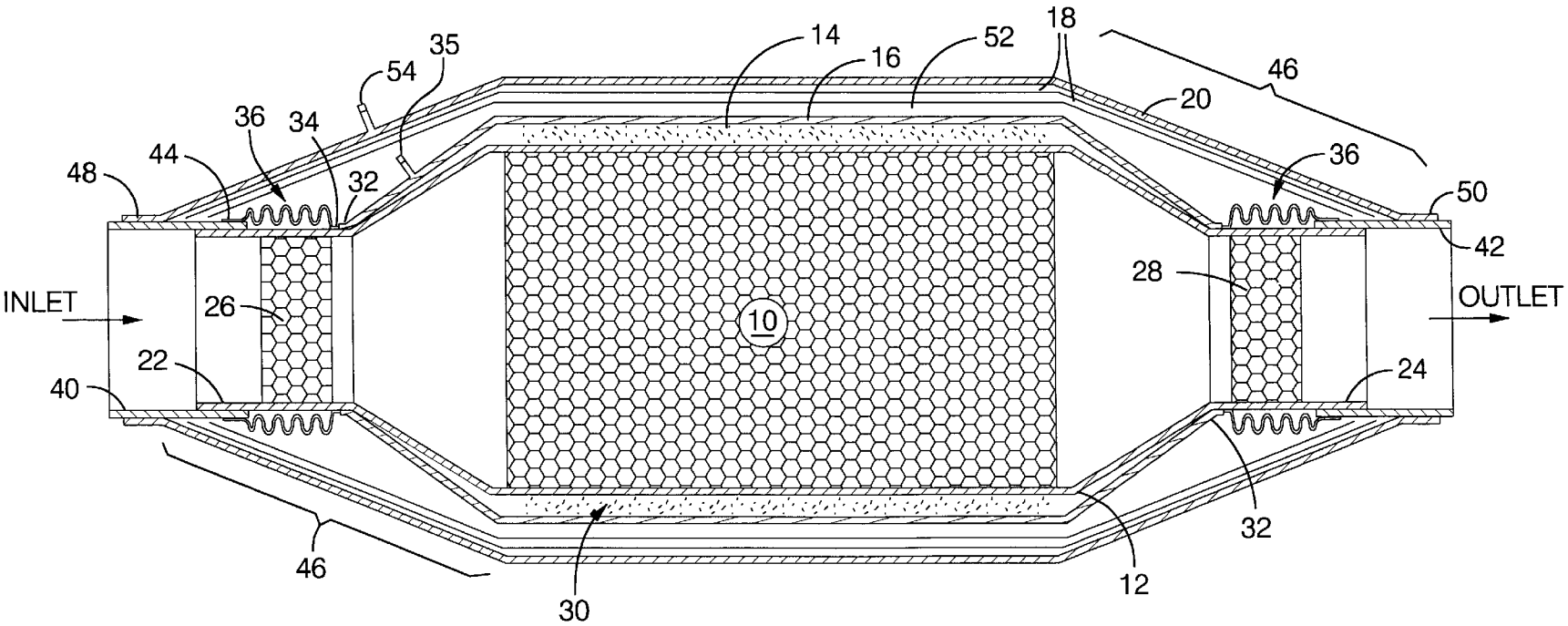
FIG. 1 is a longitudinal section of a first embodiment of the spin formed vacuum bottle catalytic converter of the invention.

Referring to FIG. 1, the invention, like other vacuum bottle catalytic converters, includes a catalytic substrate 10 mounted within an inner housing 12. Inner housing 12 is surrounded radially by a phase change material 14 which is maintained in position by phase change container 16. It will be understood that inner housing 12 and phase change container 16 form a vacuum chamber within which phase change material 14 is disposed. Radially outwardly of container 16 are at least one and preferably a plurality of radiation shields 18. These are maintained between container 16 and outer housing 20 which also constitutes a vacuum chamber (i.e. second vacuum chamber). The invention is directed to a new way in which such catalytic converters may be made that provides an alternate structure reducing the number of weld joints and the total weld joint length required to manufacture the converter.

The invention employs the process of spin forming to form the various walls of the converter with precision and to reduce the diameters thereof with the purpose of reducing necessary weld length to hermetically seal the walls together. The preferred spin forming process is disclosed in U.S. Ser. No. 08/766,269 which is assigned to the assignee hereof and incorporated herein by reference. In the invention, the various spin formed layers of material are designed to be coterminous so that a single weld joint is employable where more than one joint would have been needed before the teaching of this invention.

The process is begun with a tubular member large enough to receive catalyst or catalyst substrate 10 therein. Preferably metal substrate catalyst 10 is treated with a braze paste prior to insertion. The member is then spin formed into the shape of inner housing 12 illustrated in FIG. 1. It should be noted that in the FIG. 1 embodiment, inner housing 12 itself extends as inlet opening section 22 and outlet opening section 24 which respectively receive inlet radiation shield 26 and outlet radiation shield 28. The inlet radiation shield 26 and outlet radiation shield 28 are preferably brazed in place by applying a brazing compound to the shields. The braze compound is stabile in this condition and is flowed in a brazing furnace to flow the brazing compound and permanently mount the catalyst 10, shields 26 and 28. This embodiment benefits from reduced brazing steps.

A second tubular member having a diameter sufficient to extend circumferentially around inner housing 12 is fitted therearound; this is phase change container 16. The diameter of the member which will be spin formed into phase change container 16 is larger than the formed inner housing 12 so that an annular area 30 having a suitable radial dimension is formed. It is in annular area 30 that phase change material 14 is contained. The ends 32 of container 16 are preferably brought down with spin forming so they will meet with inside edge 34 of bellows 36 when it is installed and nest circumferentially with inner housing inlet opening section 22 and outlet opening section 24. Prior to assembly with the inner housing 12, bellows 36 is welded to extension tube 40 at outer edge 44 of bellows 36. Once bellows 36 is secured in this manner to tube 40, bellows 36 is placed over inner housing inlet tube 22 and the inner edge 34 of bellows 36 is welded simultaneously to end or edge 32 and inlet opening section 22. Referring to the outlet side of the catalytic converter the identical operation is carried out with extension tube 42 and outlet opening section 24. A cost savings is realized on both ends of the converter because of the reduced time spent by the welder and the reduced length of the weld material required. The savings is significant due to the quality of the weld required for this application. Tubes 40 and 42 are not secured to sections 22 and 24 in order to allow slippage therebetween during the differential thermal expansion between inner (hotter) layers of the converter and outer (cooler) layers of the converter.

Once the weld joint of edges 32 and 34 is created, the phase change container is capable of holding a vacuum. Thus, at this point it is preferable to partially evacuate this chamber thorough nipple 35 to an absolute pressure of about 25 KPa, the phase change material itself being preinstalled.

It may be preferable to provide radiation shields of stainless steel foil between the phase change container 16 and the outer housing 20, with insulation layers (not shown), for example of ceramic fiber, between the radiation shield layers. To avoid unnecessary processing steps, the radiation shields 18 (illustrated as two shields but, as is known, may be more) are installed in the same step as the outer housing 20 and are spin formed at the same time therewith. Preferably, pie shaped cut outs are taken from the radiation shields in the zones marked 46 so that the material need not buckle when the outer housing 20 is being spin formed. Rather, the pre-shaped cutouts close up and allow the radiation shield material to assume a frustoconical shape at either end of the converter. Outer housing 20 is spin formed down to meet extension tubes or extensions 40 and 42 and is welded thereon at housing ends 48 and 50. Subsequent to this welding operation, the annular space 52, defined by outer housing 20 and phase change container 16, is evacuated through nipple 54 to in the range of about 1–10 millitorrs absolute pressure (0.133–1.33 KPa absolute pressure). The catalytic converter of the invention is thus completed with only three weld joints on each end thereof.

Figure 2:
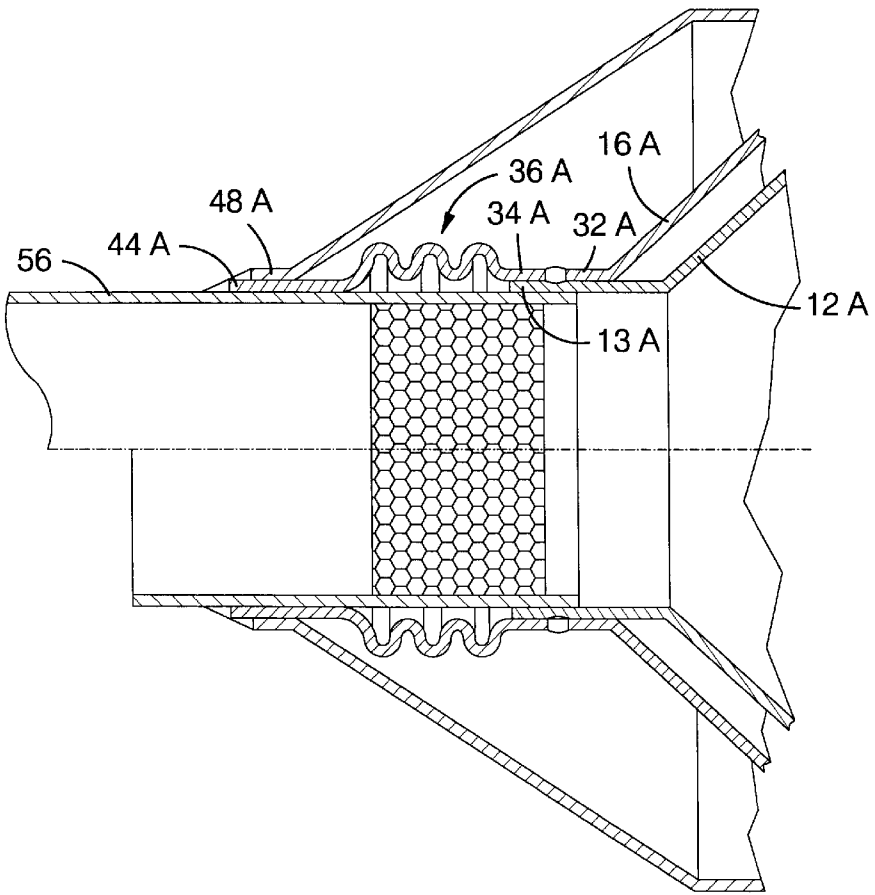
FIG. 2 is a schematic view of one end of an alternate converter of the invention.

In an alternate embodiment of the invention, referring to FIG. 2 which is a partial view of a vacuum bottle catalytic converter similar to FIG. 1 but wherein the various layers of the converter are alternately arranged, end 13A of inner housing 12A is welded directly to phase change container 16A at edge 32A of container 16A and to edge 34A of bellows 36A. The weld is preferably a single weld and penetrates all three structures to secure them together.

Concentrically inwardly nested with inner housing 12A is inlet tube 56. Bellows outer edges 44A is extended to immediately concentrically inward of housing edge or end 48A and a weld is placed so as to permanently weld edges 44A, 48A and tube 56 together simultaneously and hermetically. Differential thermal expansion of the inner members of the catalytic converter is absorbed by bellows 36A and slippage of tube 56 inside inner housing end 13A.

Figure 3:
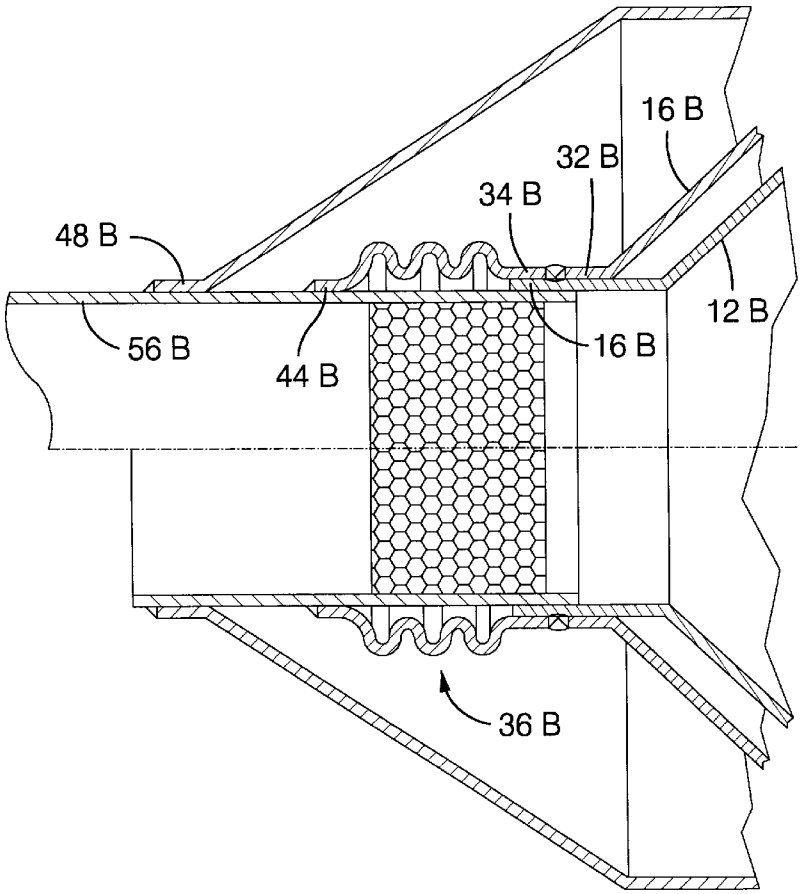
FIG. 3 is a schematic view of one end of another alternate converter of the invention.

In another alternate embodiment of the invention, referring to FIG. 3, the structure is almost identical to FIG. 2 with the only difference being the location and securement of edge or end 44B of bellows 36B. In this figure the distinct portions of the invention employ a numerically identical identifier but include a B as opposed to an A as in FIG. 2. End 44B of bellows 36B is welded individually to tube 56B. Housing end 48B is also individually welded to tube 56B. This embodiment requires an additional weld joint but maintains the functionality and mode of operation of the FIG. 2 embodiment.

An additional advantage to both of the latter embodiments is that since radiation shields 26 and 28 (only 26 shown) are fitted in tube 56A and 56B respective to the embodiments, the shields 26 and 28 may be brazed separately from primary catalyst 10. This approach allows easier inspection of the individual braze joints.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A vacuum bottle catalytic converter comprising:

an inner housing, in which is mounted a primary catalyst substrate, said inner housing having a central section of a first diameter and end sections of a second diameter;

a phase change material disposed about said inner housing central section;

a phase change container having a central section and end sections, said container enveloping said phase change material, said phase change container end sections nesting circumferentially outwardly with said inner housing end sections;

an absorber positioned adjacent each said end sections of said phase change container and said inner housing end sections, said phase container end sections, said inner housing end sections and said absorber being hermetically sealed together with a single weld joint;

an outer housing having a central section and end sections, said outer housing central section being disposed around and spaced from said phase change container creating an annulus defined by said outer housing and said phase change container; and a tube concentrically inwardly nested with each said end sections of said outer housing and concentrically inwardly nested with said absorber, said absorber and said outer housing being welded to said tube.

2. A vacuum bottle catalytic converter as claimed in claim 1 wherein said outer housing and said absorber are welded to said tube by a single weldjoint.

3. A vacuum bottle catalytic converter as claimed in claim 1 wherein each said tube further comprises a radiation shield mounted therein.

4. A vacuum bottle catalytic converter as claimed in claim 3 wherein said radiation shields are brazed to said tubes.

5. A vacuum bottle catalytic converter as claimed in claim 4 wherein said primary catalyst substrate is brazed to said inner housing.

6. A vacuum bottle catalytic converter as claimed in claim 5 wherein said primary catalyst substrate is brazed to said inner housing independently of said radiation shields being brazed to said tubes.

* * * * *